US006849592B2

(12) United States Patent
Grainger et al.

(10) Patent No.: US 6,849,592 B2
(45) Date of Patent: Feb. 1, 2005

(54) FABRIC CONDITIONING COMPOSITIONS

(75) Inventors: David Stephen Grainger, Merseyside (GB); Andrew David Green, Merseyside (GB); John Francis Hubbard, Merseyside (GB); Mansur Sultan Mohammadi, Merseyside (GB)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 103 days.

(21) Appl. No.: 10/237,484

(22) Filed: Sep. 9, 2002

(65) Prior Publication Data

US 2003/0064904 A1 Apr. 3, 2003

(30) Foreign Application Priority Data

Sep. 10, 2001 (GB) ..... 0121807

(51) Int. Cl.[7] ..... C11D 1/835
(52) U.S. Cl. ..... 510/522; 510/527
(58) Field of Search ..... 510/504, 515, 510/522, 527

(56) References Cited

U.S. PATENT DOCUMENTS

| | | | | |
|---|---|---|---|---|
| 3,915,867 | A | * 10/1975 | Kang et al. | 510/525 |
| 4,401,578 | A | 8/1983 | Verbruggen | |
| 4,772,403 | A | 9/1988 | Grandmaire et al. | |
| 5,066,414 | A | 11/1991 | Chang | |
| 5,500,137 | A | 3/1996 | Bacon et al. | |
| 6,004,913 | A | * 12/1999 | Iacobucci et al. | 510/123 |
| 6,040,287 | A | 3/2000 | Motyka et al. | |
| 6,486,121 | B2 | * 11/2002 | Wahl et al. | 510/527 |
| 6,620,777 | B2 | * 9/2003 | Heibel et al. | 510/516 |

FOREIGN PATENT DOCUMENTS

| | | | |
|---|---|---|---|
| EP | 0 409 502 A2 | | 1/1991 |
| EP | 0 409 504 A2 | | 1/1991 |
| EP | 0 730 023 A2 | | 9/1996 |
| WO | WO 98/16538 | * | 4/1998 |
| WO | 99/50378 | | 10/1999 |
| WO | 01/46361 A1 | | 6/2001 |
| WO | 01/59200 | | 8/2001 |
| WO | 02/20707 | | 3/2002 |

OTHER PUBLICATIONS

Search report under Section 17 (GB 0121807.2—dated Mar. 26, 2002).

"Quantiative $^{13}$C NMR Spectroscopy with Inverse Gated $^{1}$H–Decoupling"; *Quantitative Determinations*; pp. 234–236.

Related co–pending application: Grainger et al.; U.S. Appl. No. 10/237,481; filed Sep. 9, 2002; Fabric Conditioning Compositions.

Related co–pending application: Ilett; U.S. Appl. No. 10/237,480; filed Sep. 9, 2002; Fabric Conditioning Compositions.

Related co–pending application; Grainger et al.; U.S. Appl. No. 10/237,485; filed Sep. 9, 2002; Fabric Conditioning Compositions.

Related co–pending application; Grainger et al.; U.S. Appl. No. 10/237,427; filed Sep. 9, 2002; A Method of Preparing Fabric Conditioning Compositions.

Related co–pending application; Eyres et al.; U.S. Appl. No. 10/237,398; filed Sep.9, 2002; A Method of Reducing the Viscosity of Fabric Conditioning Compositions.

International Search Report No. PCT/EP 02/09853—dated Dec. 30, 2002—5 pp.

* cited by examiner

*Primary Examiner*—John R. Hardee
(74) *Attorney, Agent, or Firm*—Ellen Plotkin

(57) ABSTRACT

A fabric conditioning composition comprises (a) less than 7.5% by weight of a ester-linked quaternary ammonium fabric softening material comprising at least one mono-ester linked component and at least one tri-ester linked component, and (b) a fatty complexing agent wherein the weight ratio of the mono-ester linked component of compound (a) to fatty complexing agent (b) is from 5:1 to 1:5.

4 Claims, No Drawings

FABRIC CONDITIONING COMPOSITIONS

FIELD OF THE INVENTION

The present invention relates to fabric conditioning compositions. More specifically, the invention relates to fabric softening compositions comprising an ester-linked quaternary ammonium compound and a long chain fatty compound.

BACKGROUND OF THE INVENTION

It is well known to provide liquid fabric conditioning compositions which soften in the rinse cycle.

Such compositions comprise less than 7.5% by weight of softening active, in which case the composition is defined as "dilute", from 7.5% to about 30% by weight of active in which case the compositions are defined as "concentrated" or more than about 30% by weight of active, in which case the composition is defined as "super-concentrated".

In many markets around the world, it remains highly desirable to provide dilute fabric conditioning compositions since many consumer express a preference for dilute compositions over semi-dilute, concentrated and super-concentrated compositions. Such preferences include a more pleasing rheology and also because there is less chance of overdosing a dilute composition whereas it is much easier to accidentally overdose a concentrated composition.

Furthermore, dilute compositions can be advantageous to the manufacturer because the high levels of water present relative to the level of water in a concentrated composition makes the dilute composition easier to disperse in the rinse liquor without requiring additional expensive dispersion agents. Other advantages of dilute compositions over concentrated compositions include greater stability upon storage due to the greater dilution of destabilising components such as perfumes.

In traditional fabric conditioning compositions, non-ester-linked quaternary ammonium fabric softening agents have been used although there is a trend away from such compounds to ester-linked quaternary ammonium fabric softening agents.

It is desirable to use ester-linked compounds due to their inherent biodegradability.

Such ester-linked quaternary ammonium compounds contain hydrocarbyl chains which can be unsaturated, partially hardened or fully saturated.

It is particularly desirable to use substantially fully saturated quaternary ammonium fabric softening compounds due to their excellent softening capabilities and because they are more stable to oxidative degradation (which can lead to malodour generation) than partially saturated or fully unsaturated quaternary ammonium softening compounds.

Of the types of ester-linked quaternary ammonium materials known, it is desirable to use those based on triethanolamine which produce at least some mono-ester linked component and at least some tri-ester linked component since the raw material has a low melting temperature which enables the manufacturing process of the composition to occur at low temperatures. This reduces difficulties associated with high temperature handling, transport and processing of the raw material and compositions produced therefrom.

However, a problem identified with dilute fabric conditioning compositions is their apparently inferior softening performance compared to a concentrated version of the same composition. Without being bound by theory it is believed that this stems from the poorer molecular packing of the quaternary ammonium softening material in the lamellar phase of the composition when water content is high.

An additional problem associated with softening composition comprising quaternary ammonium softening materials based on triethanolamine (i.e. having a mixture of mono-, di- and tri-ester quaternary ammonium species) is their inferior softening performance, independent of their concentration, compared to those quaternary ammonium softening materials containing predominantly di-ester quaternary ammonium species.

OBJECTS OF THE INVENTION

The present invention seeks to address one or more of the above-mentioned problems, and, to give one or more of the above-mentioned benefits desired by consumers.

It has surprisingly been found that by incorporating a fatty component which comprises a long alkyl chain, such as a fatty alcohol or fatty acid (hereinafter referred to as "fatty complexing agent") into dilute softening compositions comprising a quaternary ammonium softening material having substantially fully saturated alkyl chains, at least some mono-ester linked component and at least some tri-ester linked component, the softening performance of the compositions can be dramatically improved.

It is believed that this is due to the mono-ester linked component (which does not contribute to softening) completing with the fatty complexing material and thereby providing a material which does contribute to softening.

SUMMARY OF THE INVENTION

According to the present invention there is provided a fabric conditioning composition comprising:

(a) less than 7.5% by weight of an ester-linked quaternary ammonium fabric softening material comprising at least one mono-ester linked component and at least one tri-ester linked component;

(b) a fatty complexing agent;

wherein the weight ratio of the mono-ester linked component of compound (a) to compound (c) is from 5:1 to 1:5.

There is also provided a method for treatment of fabrics comprising contacting the above-mentioned composition with fabrics in a laundry treatment process.

In the context of the present invention, the term "comprising" means "including" or "consisting of". That is the steps, components, ingredients, or features to which the term "comprising" refers are not exhaustive.

DETAILED DESCRIPTION OF THE INVENTION

The compositions of the present invention are preferably rinse conditioner compositions, more preferably aqueous rinse conditioner compositions for use in the rinse cycle of a domestic laundry process.

Quaternary Ammonium Fabric Softening Material

The fabric conditioning material used in the compositions of the present invention comprises one or more quaternary ammonium materials comprising a mixture of mono-ester linked, di-ester linked and tri-ester linked compounds.

By mono-, di- and tri-ester linked components, it is meant that the quaternary ammonium softening material comprises, respectively, a quaternary ammonium compound comprising a single ester-link with a fatty hydrocarbyl chain attached thereto, a quaternary ammonium compound comprising two ester-links each of which has a fatty hydrocarbyl chain attached thereto, and a quaternary ammonium compound comprising three ester-links each of which has a fatty hydrocarbyl chain attached thereto.

Below is shown typical levels of mono-, di- and tri-ester components in a fabric softening material used in the compositions of the invention.

| Component | % by weight of the raw material (TEA based softener with solvent) |
|---|---|
| Mono-ester | 10–30 |
| Di-ester | 30–60 |
| Tri-ester | 10–30 |
| Free fatty acid | 0.2–1.0 |
| Solvent | 10–20 |

The level of the mono-ester linked component of the quaternary ammonium material used in the compositions of the invention is preferably between 8 and 40% by weight, based on the total weight of the raw material in which the quaternary ammonium material is supplied.

The level of the tri-ester linked component is preferably between 20 and 50% based on the total weight of the raw material in which the quaternary ammonium material is supplied.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The preferred ester-linked quaternary ammonium cationic softening material for use in the invention is represented by formula (I):

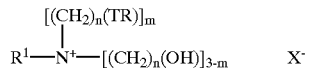

(I)

wherein each R is independently selected from a $C_{5-35}$ alkyl or alkenyl group, $R^1$ represents a $C_{1-4}$ alkyl or hydroxyalkyl group or a $C_{2-4}$ alkenyl group, T is

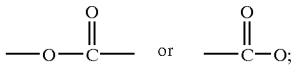

n is O is an integer selected from 1 to 4, m is 1, 2 or 3 and denotes the number of moieties to which it refers that pend directly from the N atom, and $X^-$ is an anionic group, such as halides or alkyl sulphates, e.g. chloride, methyl sulphate or ethyl sulphate.

Especially preferred materials within this class are di-alkyl and di-alkenyl esters of triethanol ammonium methyl sulphate. Commercial examples of compounds within this formula are Tetranyl® AHT-1 (di-hardened tallowyl ester of triethanol ammonium methyl sulphate 85% active), L1/90 (partially hardened tallow ester of triethanol ammonium methyl sulphate 90% active), and L5/90 (palm ester of triethanol ammonium methyl sulphate 90% active), all ex Kao corporation), Rewoquat WE18 and WE20 (both are partially hardened tallow ester of triethanol ammonium methyl sulphate 90% active), both ex Goldschmidt Corporation and Stepantex VK-90 (partially hardened tallow ester of triethanol ammonium methyl sulphate 90% active), ex Stepan Company).

Iodine Value of the Parent Fatty Acyl Group or Acid

The iodine value of the parent fatty acyl compound or acid from which the quaternary ammonium fabric softening material is formed is from 0 to 20, preferably from 0 to 5, more preferably from 0 to 2. Most preferably the iodine value of the parent fatty acid or acyl group from which the quaternary ammonium fabric softening material is formed is from 0 to 1. That is, it is preferred that the alkyl or alkenyl chains are substantially fully saturated.

If there is any unsaturated quaternary ammonium fabric softening material present in the composition, the iodine value, referred to above, represents the mean iodine value of the parent fatty acyl compounds or fatty acids of all of the quaternary ammonium materials present.

In the context of the present invention, iodine value of the parent fatty acyl compound or acid from which the fabric softening material formed, is defined as the number of grams of iodine which react with 100 grams of the compound.

In the context of the present invention, the method for calculating the iodine value of a parent fatty acyl compound/acid comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated.

The quaternary ammonium fabric softening material of formula (I) is present in an amount less than 7.5% by weight of quaternary ammonium material (active ingredient) based on the total weight of the composition, more preferably from 1 to 6.8% by weight, most preferably 2 to 5.5% by weight, e.g. 2.2–5% by weight.

Excluded Quaternary Ammonium Compounds

Quaternary ammonium fabric softening materials which are free of ester linkages or, if ester-linked, do not comprise at least some mono-ester component and some tri-ester component are excluded from the scope of the present invention. For instance, quaternary ammonium compounds having the following formulae are excluded:

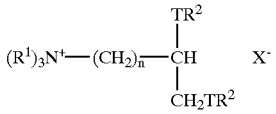

wherein $R^1$, $R^2$, T, n and $X^-$ are as defined above; and

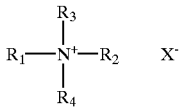

where $R_1$ to $R_4$ are not interrupted by ester-links, $R_1$ and $R_2$ are $C_{8-28}$ alkyl or alkenyl groups; $R_3$ and $R_4$ are $C_{1-4}$ alkyl or $C_{2-4}$ alkenyl groups and $X^-$ is as defined above.

Fatty Complexing Agent

The compositions of the present invention comprise a fatty complexing agent. It is believed that the fatty alcohol provides a synergistic softening benefit with the quaternary ammonium softening material which is particularly noticeable in dilute fabric conditioning compositions.

The applicants believe that that this is due to the mono-ester linked component (which does not contribute to softening) complexing with the fatty complexing material and thereby providing a material which does contribute to softening.

Especially suitable fatty complexing agents include fatty alcohols and fatty acids. Of these, fatty alcohols are most preferred.

Preferred fatty acids include hardened tallow fatty acid (available under the tradename Pristerene, ex Uniqema).

Preferred fatty alcohols include hardened tallow alcohol (available under the tradenames Stenol and Hydrenol, ex Cognis and Laurex CS, ex Albright and Wilson) and behenyl alcohol, a C22 chain alcohol, available as Lanette 22 (ex Henkel).

The fatty complexing agent is present in an amount from 0.01% to 15% by weight based on the total weight of the composition. More preferably, the fatty component is present in an amount of from 0.05 to 10%, most preferably from 0.1 to 5%, e.g. 0.3 to 4% by weight, or even 0.4 to 1.9% by weight.

The weight ratio of the mono-ester component of the quaternary ammonium fabric softening material to the fatty complexing agent is preferably from 5:1 to 1:5, more preferably 4:1 to 1:4, most preferably 3:1 to 1:3, e.g. 2:1 to 1:2.

Calculation of Mono-Ester Linked Component of the Quaternary Ammonium Material

The quantitative analysis of mono-ester linked component of the quaternary ammonium material is carried out through the use of Quantitative $^{13}C$ NMR spectroscopy with inverse gated $^{1}H$ decoupling scheme.

The sample of known mass of the quaternary ammonium raw material is first dissolved in a known volume of $CDCl_3$ along with a known amount of an assay material such as naphthalene. A $^{13}C$ NMR spectrum of this solution is then recorded using both an inverse gated decoupling scheme and a relaxation agent. The inverse gated decoupling scheme is used to ensure that any Overhauser effects are suppressed whilst the relaxation agent is used to ensure that the negative consequences of the long $t_1$ relaxation times are overcome (ie adequate signal-to-noise can be achieved in a reasonable timescale).

The signal intensities of characteristic peaks of both the carbon atoms in the quaternary ammonium material and the naphthalene are used to calculate the concentration of the mono-ester linked component of the quaternary ammonium material. In the quaternary ammonium material, the signal represents the carbon of the nitrogen-methyl group on the quaternary ammonium head group. The chemical shift of the nitrogen-methyl group varies slightly due to the different degree of esterification; characteristic chemical shifts for the mono-, di- and tri-ester links are 48.28, 47.97 and 47.76 ppm respectively. Any of the peaks due to the napthalene carbons that are free of interference from other components can then be used to calculate the mass of mono-ester linked component present in the sample as follows:

$$\text{Mass}_{MQ}(\text{mg/ml})=(\text{mass}_{Naph}\times I_{MQ}\times N_{Naph}\times M_{MQ})/(I_{Naph}\times N_{MQ}\times M_{Naph})$$

where $\text{Mass}_{MQ}$=mass mono-ester linked quaternary ammonium material in mg/ml, $\text{mass}_{Naph}$=mass naphthalene in mg/ml, I=peak intensity, N=number of contributing nuclei and M=relative molecular mass. The relative molecular mass of naphthalene used is 128.17 and the relative molecular mass of the mono-ester linked component of the quaternary ammonium material is taken as 526.

The weight percentage of mono-ester linked quaternary ammonium material in the raw material can thus be calculated:

% of mono-ester linked quaternary ammonium material in the raw material=$(\text{mass}_{MQ}/\text{mass}_{HT\text{-}TEA})\times 100$ where $\text{mass}_{HT\text{-}TEA}$=mass of the quaternary ammonium material and both $\text{mass}_{MQ}$ and $\text{mass}_{HT\text{-}TEA}$ are expressed as mg/ml.

For a discussion of the NMR technique, see "100 and More Basic NMR Experiments", S Braun, H-O Kalinowski, S Berger, 1st edition, pages 234–236.

Nonionic Surfactant

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

—O—, —C(O)O—, —C(O)N(R)— or —C(O)N(R)R— in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO (18), tallow alcohol-EO(25), coco alcohol-EO(10), coco alcohol-EO(15), coco alcohol-EO(20) and coco alcohol-EO (25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11) ; $C_{20}$ EO(11) ; and $C_{16}$ EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately Herein above can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 10%, more preferably 0.1 to 5%, most preferably 0.35 to 3.5%, e.g. 0.5 to 2% by weight, based on the total weight of the composition.

Perfume

The compositions of the invention preferably comprise one or more perfumes.

The hydrophobicity of the perfume and oily perfume carrier are measured by ClogP. ClogP is calculated using the "ClogP" program (calculation of hydrophobicities as logP (oil/water)) version 4.01, available from Daylight Chemical Information Systems Inc of Irvine Calif., USA.

It is well known that perfume is provided as a mixture of various components.

It is preferred that at least a quarter (by weight) or more, preferably a half or more of the perfume components have a ClogP of 2.0 or more, more preferably 3.0 or more, most preferably 4.5 or more, e.g. 10 or more.

Suitable perfumes having a ClogP of 3 or more are disclosed in U.S. Pat. No. 5,500,137.

The perfume is preferably present in an amount from 0.01 to 10% by weight, more preferably 0.05 to 5% by weight, most preferably 0.5 to 4.0% by weight, based on the total weight of the composition.

Liquid Carrier

The liquid carrier employed in the instant compositions is preferably water due to its low cost relative availability, safety, and environmental compatibility. The level of water in the liquid carrier is more than about 50%, preferably more than about 80%, more preferably more than about 85%, most preferably 90% or more, by weight of the carrier. The level of liquid carrier is greater than about 50%, preferably greater than about 65%, more preferably greater than about 80%, most preferably greater than 90%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Co-Active Softeners

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate. If GMS is present, then it is preferred that the level of GMS in the composition, is from 0.01 to 10 wt %, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

Polymeric Viscosity Control Agents

It is useful, though not essential, if the compositions comprise one or more polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

Further Optional Ingredients

Other optional nonionic softeners, bactericides, soil-releases agents may also be incorporated in the compositions of the invention.

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, antioxidants, sunscreens, anti-corrosion agents, drape imparting agents, anti-static agents, anionic carryover protection aids, ironing aids and dyes.

Product Form

In its undiluted state at ambient temperature the product comprises an aqueous liquid.

The compositions are preferably aqueous dispersions of the quaternary ammonium softening material.

Product Use

The composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

It is also possible, though less desirable, for the compositions of the present invention to be used in industrial laundry operations, e.g. as a finishing agent for softening new clothes prior to sale to consumers.

Preparation

The compositions of the invention may be prepared according to any suitable method.

In a first preferred method, the quaternary ammonium material, fatty complexing agent, and optionally the nonionic stabilising agent and perfume are heated together until a co-melt is formed. Water is then heated and the co-melt is added to water with stirring. Alternatively, perfume can be added hot after the melt is formed or can be added after the mixture has cooled or during different stages of cooling.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Example 1

Softening Evaluation

Sample A was prepared at 200 ml scale. The nonionic stabilising agent and the ester linked quaternary ammonium compound were heated together to between 50 and 60° C. and stirred in order to provide a co-melt. The co-melt was then slowly added to water also at the same temperature while agitating. After 10 minutes of mixing, the batch was cooled using recirculating cold water. No shearing or milling was used during the process.

Samples 1 and 2 were prepared by co-melting the quaternary ammonium fabric softening material, tallow alcohol and nonionic stabiliser together, heating water and adding the co-melt to the water under stirring. Stirring was continued until a homogeneous mixture was formed.

Sample B is dilute Comfort (bought in UK August 2000). It does not contain any fatty complexing agent and was dosed so that the level of softening agent was equivalent to that in sample A.

TABLE 1

| Sample | A | 1 | 2 |
|---|---|---|---|
| AHT-1[a] | 5.29 | 4.11 | 4.63 |
| Fatty complexing agent[b] | 0 | 1.01 | 0.56 |
| Coco 20EO[c] | 0.1 | 0.1 | 0.1 |
| Water | To 100 | To 100 | To 100 |
| Ratio of mono-ester component to fatty complexing agent | — | 0.69:1 | 1.40:1 |

[a]di-hardened tallowyl ester of triethanol ammonium methyl sulphate (available as 85% active material in 15% IPA, ex Kao)
[b]tallow alcohol (available as Laurex CS, ex Albright and Wilson)
[c]Genapol C200 (ex Clariant)

Softening Results were Assessed as Follows:

Softening performance was evaluated by adding an amount of each sample corresponding to 2.22 g of the fabric softening compound to 1 liter of Wirral tap water, at ambient temperature in a tergotometer. Three pieces of terry towelling (8 cm×8 cm, 40 g total weight) were added to the tergotometer pot. The cloths were treated for 5 minutes at 65 rpm, spin dried to remove excess liquor and line dried overnight and conditioned at 21° C./65° relative humidity for 24 hours.

Softening of the fabrics was assessed by an expert panel of 4 people using a round robin paired comparison test protocol. Each panel member assessed four sets of test cloths. Each set of test cloths contained one cloth of each test system under a evaluation. Panel members were asked to assess softness on a 8 point scale. Softness scores were calculated using an "Analysis of Variance" technique. Lower values are indicative of better softening. "Pref" denotes the number of votes cast during the round robin paired comparison exercise.

The results are given in table 2.

TABLE 2

| | Test 1 | | Test 2 | | Test 3 | | Average | |
|---|---|---|---|---|---|---|---|---|
| Sample | Rank | Pref | Rank | Pref | Rank | Pref | Rank | Pref |
| A | 4.85 | 8 | 4.25 | 13 | 4.5 | 5 | 4.53 | 8.67 |
| B | 4.25 | 73 | 3.25 | 77 | 3.5 | 65 | 3.67 | 71.67 |
| 1 | 4.375 | 60 | 3 | 48 | 4 | 65 | 3.79 | 57.67 |
| 2 | 4.25 | 59 | 4.125 | 62 | 4.125 | 65 | 4.16 | 62.00 |

The softening results show that, in spite of the level of quaternary ammonium softening material present in sample A (higher than the combined level of quaternary ammonium softening material and fatty alcohol in samples 1 and 2), the softening results for sample 1 and 2 are significantly better than those for sample A, thereby demonstrating a synergistic effect due to the combination of the quaternary ammonium softening material and the fatty complexing agent. Furthermore, the softening performance of sample 1 is substantially as good as the premium brand fabric conditioner (which comprises a different quaternary ammonium material, having substantially higher amounts of di-ester linked component, e.g. 80% or more by weight of the quaternary ammonium material is di-ester linked), traditionally considered to provide better softening performance than compositions comprising a quaternary ammonium material based on triethanolamine).

What is claimed is:

1. A fabric conditioning composition comprising:

(a) less than 7.5% by weight of a ester-linked quaternary ammonium fabric softening material comprising at least one mono-ester linked component and at least one tri-ester linked component;

(b) a fatty complexing agent;

wherein the weight ratio of the mono-ester linked component of compound (a) to fatty complexing agent (b) is about 5:1 to about 1:5; and wherein the fatty complexing agent is tallow alcohol.

2. A composition as claimed in claim 1, wherein the quaternary ammonium material is represented by formula (I):

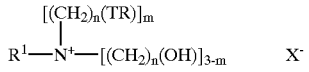

(I)

wherein each R is independently selected from a $C_{5-35}$ alkyl or alkenyl group, $R^1$ represents a $C_{1-4}$ alkyl or hydroxyalkyl group or a $C_{2-4}$ alkenyl group,

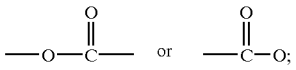

T is n is O or an integer selected from 1 to 4, m is 1, 2 or 3 and denotes the number of moieties to which it refers that pend directly from the N atom, and $X^-$ is an anionic group, such as halides or alkyl sulphates, e.g. chloride, methyl sulphate or ethyl sulphate.

3. A composition as claimed in claim 1, further comprising an oily sugar derivative.

4. A method for treatment of fabrics comprising contacting the composition as claimed in claim 1 with fabrics in a laundry treatment process.

* * * * *